US006494001B1

(12) United States Patent
Ketonen et al.

(10) Patent No.: US 6,494,001 B1
(45) Date of Patent: Dec. 17, 2002

(54) PROCEDURE FOR INSTALLING A LANDING DOOR, AND A CORRESPONDING INSTALLATION SYSTEM

(75) Inventors: Ari Ketonen, Hyvinkää ; Jori Hägg, Riihimäki; Harri Anttila, Jokela, all of (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/530,798

(22) PCT Filed: Oct. 15, 1998

(86) PCT No.: PCT/FI98/00806

§ 371 (c)(1),
(2), (4) Date: Jun. 21, 2000

(87) PCT Pub. No.: WO99/24347

PCT Pub. Date: May 20, 1999

(30) Foreign Application Priority Data

Nov. 6, 1997 (FI) ..... 974158
Sep. 15, 1998 (FI) ..... 981992

(51) Int. Cl.[7] ..... E06B 1/04

(52) U.S. Cl. ..... 52/204.1; 52/204.2; 52/656.2; 52/656.4; 52/745.16; 49/504

(58) Field of Search ..... 52/204.1, 204.2, 52/656.1, 656.2, 656.4, 745.15, 745.16; 49/504, 505

(56) References Cited

U.S. PATENT DOCUMENTS 1,321,610 A * 11/1919 Emrich ..... 52/212
3,741,351 A * 6/1973 Suozzo ..... 187/313
4,561,210 A * 12/1985 Kvas et al. ..... 49/372
5,445,244 A * 8/1995 Ketonen ..... 187/325
5,479,754 A * 1/1996 Pelvilain et al. ..... 52/745.16
5,746,033 A * 5/1998 Chuang ..... 52/213

FOREIGN PATENT DOCUMENTS

GB A826175 12/1959
WO A1-9532912 12/1995

OTHER PUBLICATIONS

Patent Abstracts of Japan, abstract of JP 10–1275 A, Jan. 6, 1998.

Patent Abstracts of Japan, abstact of JP 4–133990 A, May 7, 1992.

Patent Abstracts of Japan, abstract of JP 3–297789 A, Dec. 27, 1991.

* cited by examiner

*Primary Examiner*—Carl D. Friedman
*Assistant Examiner*—Brian E. Glessner
(74) *Attorney, Agent, or Firm*—Birch, Stewart, Kolasch & Birch, LLP

(57) ABSTRACT

Procedure for the installation of a landing door, in which a threshold module is mounted on the lower edge of a door opening of the elevator shaft, whereupon side posts are mounted at the edges of the opening and a lintel connecting the side posts as well as an overhead supporter for the suspension of the door panels are mounted in the upper part of the opening. The equally long side posts are mounted on top of the threshold module while the side posts are connected to each other by the lintel mounted on top of them. The overhead supporter is lifted up onto the lintel and fixed to the wall by its ends.

17 Claims, 3 Drawing Sheets

PROCEDURE FOR INSTALLING A LANDING DOOR, AND A CORRESPONDING INSTALLATION SYSTEM

This application is the national phase under 35 U.S.C. § 371 of PCT International Application No. PCT/FI98/00806 which has an International filing date of Oct. 15, 1998, which designated the United States of America.

FIELD OF THE INVENTION

The present invention relates to a procedure for installing a landing door and to an installation system.

DESCRIPTION OF THE BACKGROUND ART

Traditionally, to install a landing door for an elevator, a threshold module is mounted on the lower edge of the door opening, in a horizontal position and at the correct distance from the elevator car. Next, the side posts are mounted at the side edges of the door opening to form door jambs, in a position as accurately vertical as possible and in alignment with the threshold module. The side posts can be connected by their upper ends together by a lintel, which can also be fastened by its ends to the edges of the door opening. After this, the overhead supporter is fixed to the upper part of the door opening by lifting it up to its position and fastening it with bolts to the edges of the door opening in a position as accurately horizontal as possible, i.e. parallel to the threshold module.

The prior-art procedure involves several drawbacks. Installation must be carried out by resorting to welding and observing relatively accurate measurements, so it imposes strict requirements regarding the dimensioning of the door opening. Installation is difficult and slow because practically every part of the door must be measured separately and mounted in the correct position relative to the door opening. The relatively heavy overhead supporter must be supported manually during the mounting and measurement. In addition, especially in high-rise elevator shafts, tolerance problems are encountered because the door openings must be relatively accurately positioned and sufficiently small to allow the door parts to be accurately installed in position.

BRIEF SUMMARY OF THE INVENTION

The object of the present invention is to eliminate the drawbacks described above. A specific object of the invention is to present a new type of procedure and a corresponding system that makes it possible to assemble the landing door in as simple a manner as possible and without welding and laborious or difficult operations. A further object of the invention is to reduce the tolerance requirements regarding the construction of elevator shafts.

In the procedure of the invention for the installation of a landing door, a threshold module is mounted on the lower edge of the door opening, in a position as accurately horizontal as possible and in a suitable position relative to the depth dimension of the door opening. After this, according to the invention, side posts of a length as precisely equal to each other as possible are mounted on top of the threshold module and attached to the threshold module by their lower ends, while the top ends of the side posts are connected to each other by a lintel mounted on top of them. Next, the overhead supporter is lifted up and allowed to rest on the lintel. The overhead supporter remains in position as it is supported by the lintel and thus it can be easily fixed to the wall by its ends.

It is possible to leave the overhead supporter resting on the lintel by its own weight, held in position only by suitable fitting parts and brackets, but preferably the overhead supporter, after being placed in position on the lintel, is attached to the lintel e.g. using suitable bolts.

In an embodiment of the invention, the cross-measure of the door opening formed by the side posts and the lintel is taken and the door opening is straightened and attached to the wall before the overhead supporter is lifted into position. Another possibility is to lift the overhead supporter into position on the lintel and cross-measure the door opening only when the overhead supporter is being attached to the wall.

The essential point in the procedure of the invention is that, after the threshold module has been mounted in position, no accurate measurements to determine the vertical or horizontal alignment of different parts are required, but the parts can be simply put together and bolted to the wall of the elevator shaft after only taking the cross-measure. The heavy overhead supporter need not be measured and fitted into position, but simply lifting it onto the lintel will suffice to make sure that the overhead supporter is in the correct position.

The system of the invention for the installation of a landing door comprises a threshold module to be mounted on the lower edge of the door opening, side posts, a lintel and an overhead supporter, from which the door panels are suspended. According to the invention, the lintel mounted on top of the side posts comprises fitting parts and the overhead supporter comprises corresponding brackets so that the overhead supporter can be lifted into position on the lintel, the overhead supporter remaining in its final mounting position on the lintel. After this, the overhead supporter can be locked or fixed to the lintel and also to the wall without having to be otherwise supported during the mounting operation.

The fitting parts of the lintel preferably comprise slots, openings, sleeves, supporting pins or equivalent elements or areas for the brackets of the overhead supporter. Likewise, the brackets preferably consist of tongues, pins, lugs or equivalent projections adapted to the fitting parts. Moreover, the brackets can advantageously be shaped in different ways and different supporting structures can be added to the lintel. Of course it is obvious in the framework of the inventive idea that the fitting parts and brackets may be arranged the other way round on the lintel and overhead supporter, in other words, the essential point is that the lintel and the overhead supporter are provided with mutually corresponding elements that enable the overhead supporter to rest on the lintel by its own weight.

The ends of the overhead supporter are preferably provided with fixing points by which the overhead supporter, resting on the lintel in precisely the correct position relative to the door opening, can be fixed to the wall.

The lintel is preferably likewise provided with mounting brackets by which the lintel, resting on the side posts, can be attached to the wall after the cross-measurement of the door opening formed by the side posts and the lintel. The mounting brackets or their attachments to the wall are preferably of a flexible or sliding type to permit the assembly formed by the lintel and side posts to be moved to a suitable distance from the wall, i.e. to a precisely vertical position over the threshold module.

The system of the invention for the installation of a landing door allows the door frame to be assembled from parts that need no welding. Thus, it will be possible to use pre-coated sheet material, resulting in obvious cost savings. The invention can be implemented using a lintel of a light structure that is easy to mount and adjust in position on the side posts while at the same time serving as a mounting jig and support for the overhead supporter. Therefore, the overhead supporter can be allowed to rest on the lintel and it can then be permanently fixed to the wall by its ends. Moreover, the invention simplifies the process of constructing the elevator shaft as a whole because the entire door structure is measured and installed based on the lower edge of the door opening. Thus, the side and top edges of the door opening are not subject to any strict requirements regarding dimensional accuracy.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description

BRIEF DESCRIPTION OF THE DRAWINGS

In the following, the invention will be described in detail by referring to the attached drawings, wherein.

DETAILED DESCRIPTION OF THE INVENTION

Figure 1:
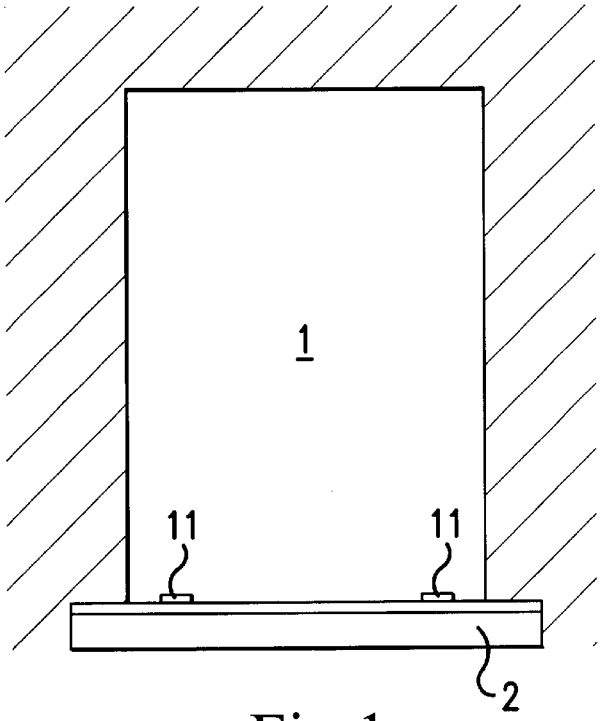
FIG. 1 represents the first stage of the installation procedure of the invention.
Figure 2:
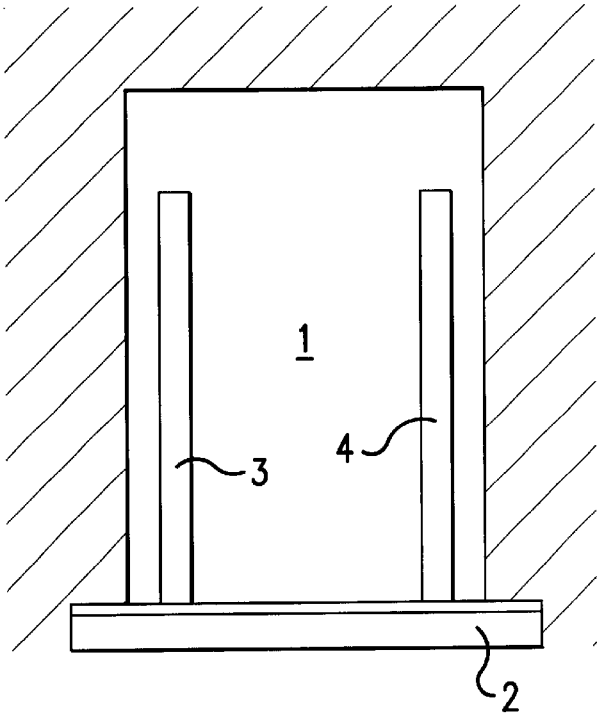
FIG. 2 represents the second stage of the installation procedure.

As illustrated by FIG. 1, a threshold module 2 is fixed to the lower edge of a door opening 1 of an elevator shaft, in a horizontal position and correctly positioned in the depth direction of the door opening 1. On its top, the threshold module 2 has mounting areas 11 to which the lower ends of the side posts 3 and 4 are attached as illustrated by FIG. 2.

Figure 3:
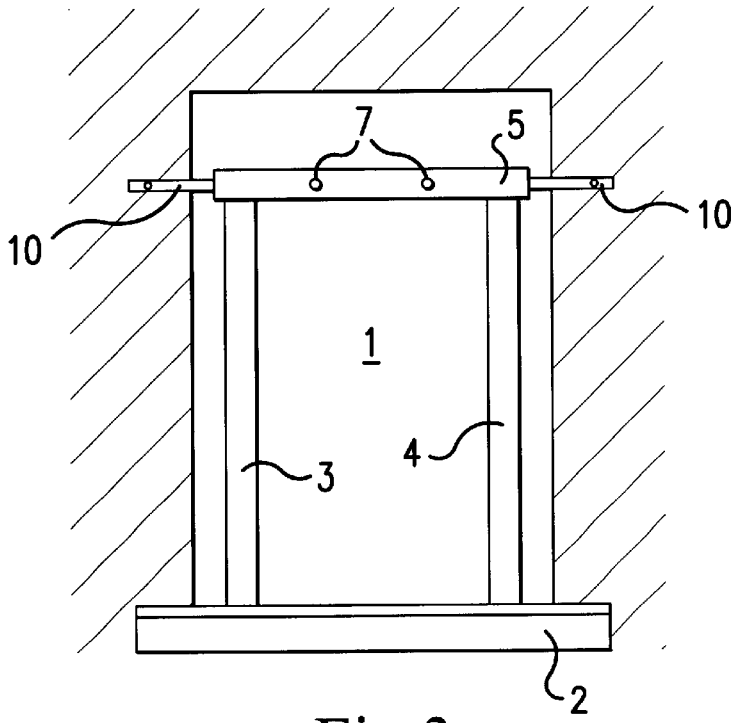
FIG. 3 represents the third stage of the installation procedure.

After this, as illustrated by FIG. 3, a lintel 5 of a relatively light structure is mounted horizontally on top of the side posts 3 and 4. Each end of the lintel is provided with a mounting bracket 10 extending over the edge of the door opening onto the wall. The cross-measure of the opening formed by the side posts 3 and 4 and the lintel 5 is checked to ensure that the opening is straight, whereupon the lintel is preliminarily fastened to the wall from the holes at the: ends of the mounting brackets 10. After this, the vertical alignment of the side posts 3 and 4 on the threshold module 2 is checked and adjusted, whereupon the mounting brackets 10 are tightened in position on the wall.

Figure 4:
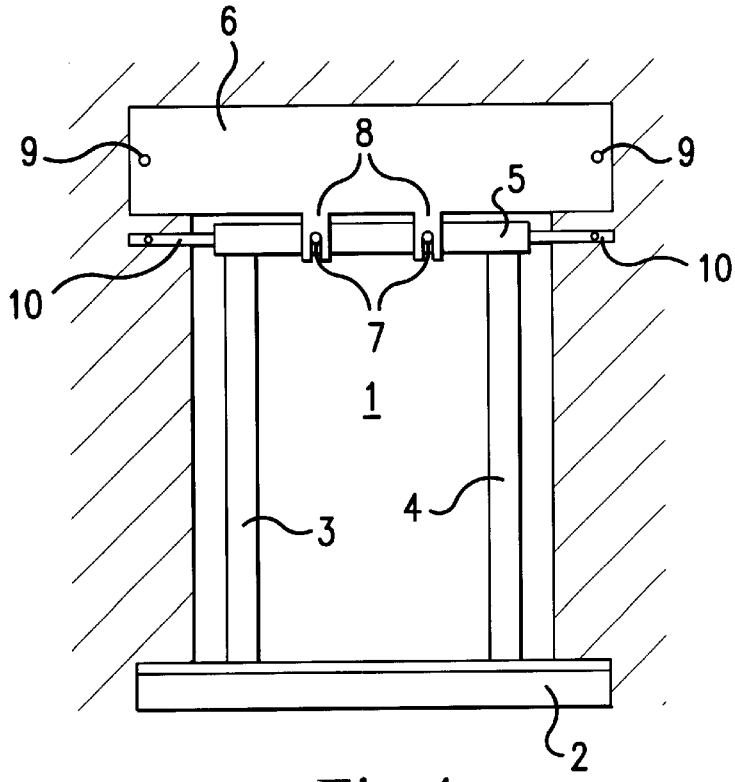
FIG. 4 represents the fourth stage of the installation procedure.

Next, as illustrated by FIG. 4, the overhead supporter 6 can be lifted onto the lintel so that its brackets 8 engage the pins 7 of the lintel. Thus, after being lifted onto the lintel, the overhead supporter 6 will remain in place without any additional support while at the same time being accurately positioned in its final installation position. The overhead supporter is therefore easy to fix permanently to the wall by the fixing points 9 at the ends by using suitable bolts. In addition, either before or after being attached to the wall, the overhead supporter 6 and the lintel 5 can be attached to each other by the fitting parts 7 and the brackets 8.

Figure 5:
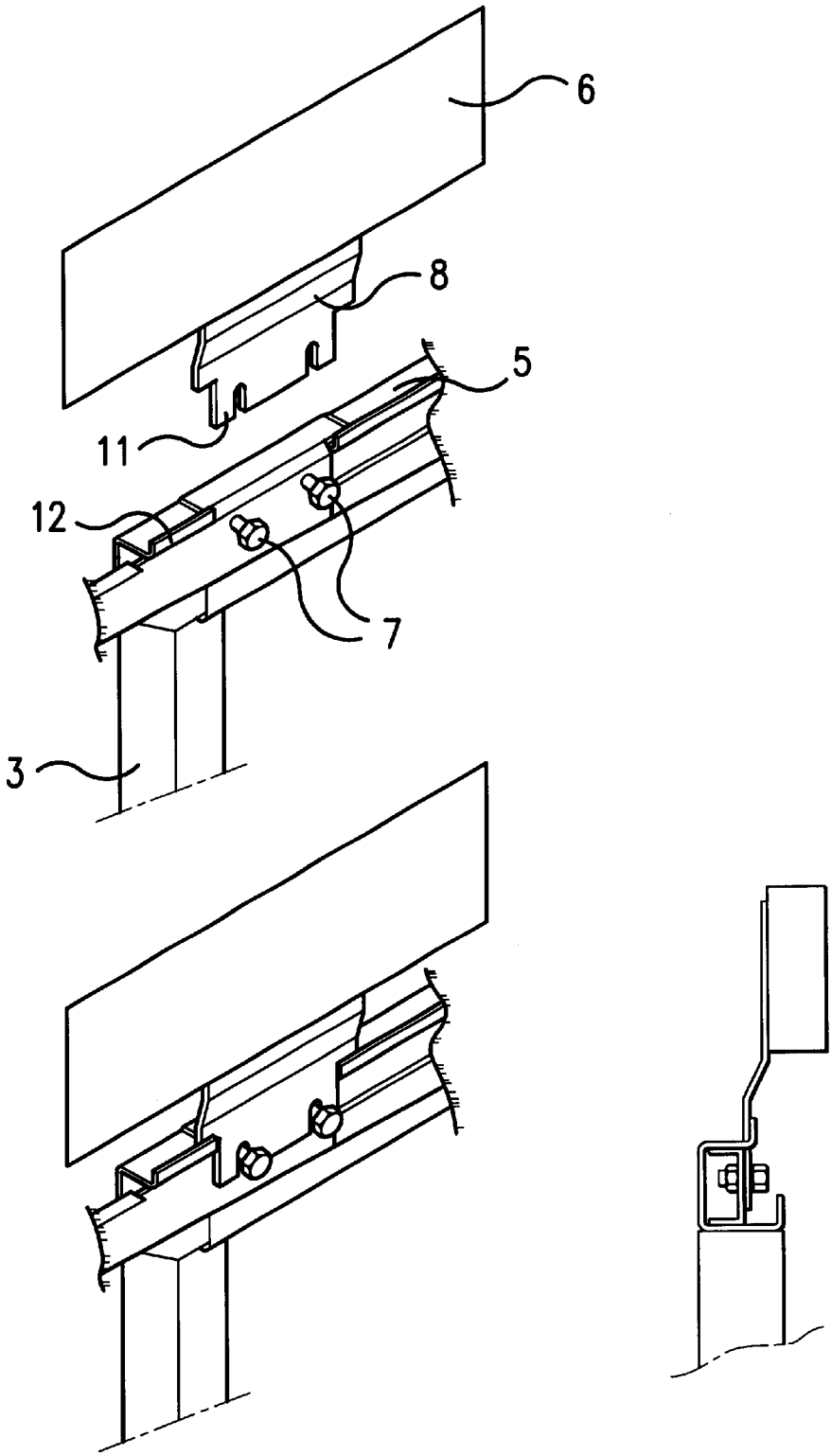
FIG. 5 presents a detail of the installation procedure.

FIG. 5 presents a detail of a preferred installation system, in which the bracket 8 is so shaped that lugs 11 comprised in the bracket 8 intermesh with a supporting structure 12 comprised in the lintel 5. The supporting structure 12 may be e.g. a shaped portion of the lintel 5, a separate part attached to the lintel 5 or some other supporting element. With this arrangement, the overhead supporter 6 will remain in place supported by the bracket 8 and the lintel 5 so that it is not necessary to immediately tighten the fitting parts 7 to fix the overhead supporter 6 to the lintel 5. This procedure allows safer and faster installation as the overhead supporter 6 is held in place on the lintel 5 without being supported manually, and it makes it easier to fasten the fitting parts 7.

In the foregoing, the invention has been described by way of example by the aid of the drawings while different embodiments of the invention are possible within the scope of the inventive idea defined by the claims.

What is claimed is:

1. A procedure for installation of a landing door, the procedure comprising the steps of:

mounting a threshold module on a lower edge of a door opening of an elevator shaft;

mounting side posts at edges of the opening, the side posts being mounted on top of the threshold module;

connecting the side posts with a lintel, the lintel being mounted to the side posts, the lintel having ends which extend beyond the side posts;

fixing at least one of the ends of the lintel to the wall;

placing an overhead supporter on the lintel at an upper part of the opening, the overhead supporter resting on the lintel and being for suspension of door panels; and fixing ends of the overhead supporter to the wall.

2. The procedure as set forth in claim 1, wherein the step of fixing at least one of the ends of the lintel to the wall occurs before the step of fixing ends of the overhead supporter to the wall.

3. The procedure as set forth in claim 2, wherein the step of fixing at least one end of the lintel further includes the step of mounting both of the ends of the lintel to the wall.

4. The procedure as set forth in claim 1, wherein the side posts are generally a same length and further comprising the step of mounting the lintel on top of the side posts.

5. The procedure as set forth in claim 1, further comprising the step of attaching the overhead supporter to the lintel while the overhead supporter is resting on the lintel.

6. The procedure as set forth in claim 1, further comprising the step of cross-measuring the lintel and the side posts and fixing the lintel and side posts to the wall before the overhead supporter is brought to rest on the lintel.

7. An installation system for a landing door, comprising:

a threshold module to be attached to a lower end of a door opening of an elevator shaft;

side posts which are attached to the threshold module;

a lintel which is mounted on the side posts, the lintel having fitting parts and having ends which extend beyond the side posts, at least one of the ends of the lintel being fixable to the wall;

a bracket attached to the at least one of the ends of the lintel for fixing the at least one of the ends to the wall; and an overhead supporter having at least one bracket which mates with the fitting parts when the overhead supporter rests on the lintel whereby the overhead supporter rest on the lintel so that the overhead supporter is fixable to an edge of the door opening.

8. The installation system as set forth in claim 7, wherein an end of the lintel is fixable to the wall before the overhead supporter is fixed to the edge of the door opening.

9. The installation system as set forth in claim 8, wherein both of the ends of the lintel are mountable to the wall.

10. The installation system as set forth in claim 7, wherein the lintel is mounted on top of the side posts.

11. The installation system as set forth in claim 10, wherein the side posts are generally a same length.

12. The installation system as set forth in claim 7, wherein the fitting parts of the lintel comprises at least one of slots, holes, sleeves and supporting pins which engage the at least one bracket of the overhead supporter.

13. The installation system as set forth in claim 7, wherein the at least one bracket of the overhead supporter comprises at least one of tongues, pins, and lugs which engage the fitting parts of the lintel.

14. The installation system as set forth in claim 13, wherein the at least one bracket has at least one lug which is engaged with at least one of the supporting elements in the lintel.

15. The installation system as set forth in claim 7, wherein the overhead supporter includes fixing points for fixing the overhead supporter resting on the lintel to the wall.

16. The installation system as set forth in claim 15, wherein the at least one bracket includes a flexible element for permitting the lintel and side posts to be moved perpendicularly a predetermined distance from the wall.

17. The installation system as set forth in claim 7, wherein the lintel includes mounting brackets at each end by which the lintel, resting on the side posts, is attachable to the wall after cross-measurement of the side posts and the lintel.

* * * * *